United States Patent [19]

Cavanagh

[11] Patent Number: 4,515,313

[45] Date of Patent: May 7, 1985

[54] AIR KNIFE APPARATUS

[75] Inventor: Kenneth M. Cavanagh, Warwick, R.I.

[73] Assignee: Marshall and Williams Company, Greenville, S.C.

[21] Appl. No.: 452,884

[22] Filed: Dec. 27, 1982

[51] Int. Cl.[3] ..... B05B 1/32

[52] U.S. Cl. ..... 239/455

[58] Field of Search ..... 239/455

[56] References Cited

U.S. PATENT DOCUMENTS 2,349,558 5/1944 Offen ..... 239/455 X 2,940,418 6/1960 Penrod et al. ..... 239/455 X 3,081,951 3/1963 Dyer et al. ..... 239/455

4,270,702 6/1981 Nicholson ..... 239/455

*Primary Examiner*—Andres Kashnikow

*Assistant Examiner*—Kevin Patrick Weldon

*Attorney, Agent, or Firm*—Bailey & Hardaway

[57] ABSTRACT

An air knife is illustrated having an adjustable orifice which includes a flat plate forming a baffle on one side while on the other side a flexible plate is secured along one edge to the circular plenum offering a free edge portion which may be drawn inwardly with respect to the flat plate to form an adjustable opposite side of the orifice.

2 Claims, 3 Drawing Figures

AIR KNIFE APPARATUS

BACKGROUND OF THE INVENTION

This invention relates to an improvement upon air knives of the general type illustrated in U.S. Pat. Nos. 2,940,418 and 4,270,702. The air knife may be of lighter general construction when made in accordance with the invention and an improved flow path with less turbulence results. The flow should have a lesser pressure drop because of the more streamlined flow path.

SUMMARY OF THE INVENTION

It has been found that an improved air knife construction may be made having improved features relating to adjustable air flow characteristics by utilizing a plate forming a flexible baffle on one side of the orifice carried on one side of the longitudinal opening in the circular plenum while the flexible blade has a free edge portion which is adjustable toward and away from the baffle carried substantially tangentially with the plenum forming the other side of the orifice.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
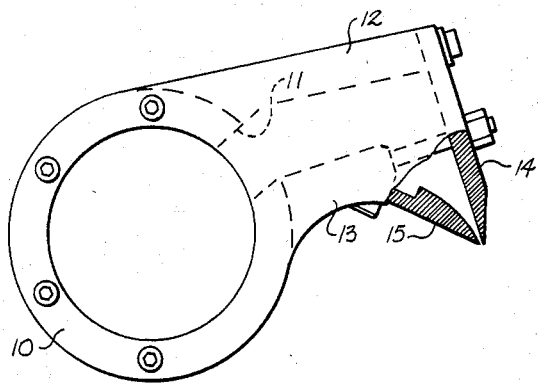
PRIOR ART Fig. 1
FIG. 1 illustrates an air knife constructed in accordance with the prior art.

The prior art is illustrated in FIG. 1 as including an air knife having a circular plenum 10 with an opening 11 therein having spaced upper and lower supports 12 and 13. These supports carry the converging plates 14 and 15 for forming the orifice. U.S. Pat. No. 4,270,702 illustrates the use of a flexible baffle carried by the upper support which may be threadably deflected inwardly to adjust the size of the orifice.

Figure 2:
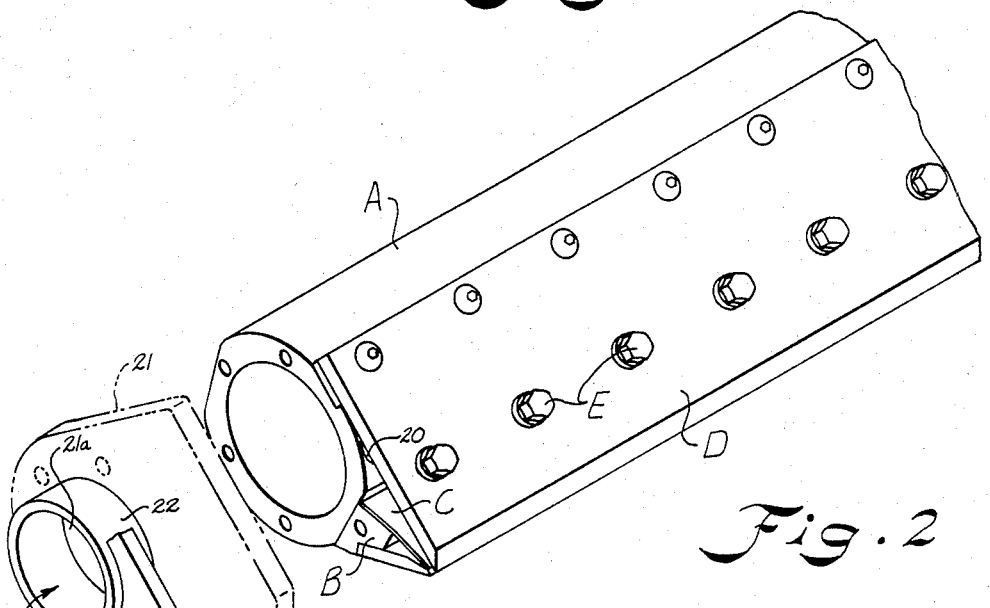
FIG. 2 is a perspective view illustrating an air knife constructed in accordance with the present invention.
Figure 3:
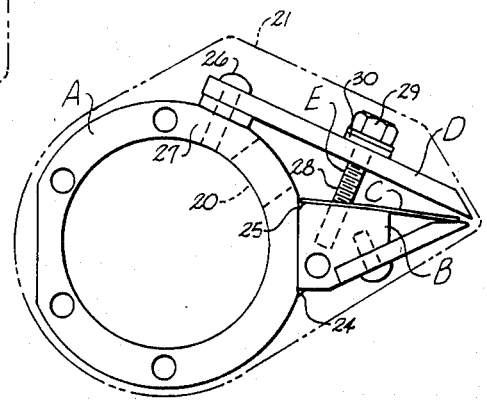
FIG. 3 is an end elevation with the end plate and support bracket shown in broken lines illustrating an adjustable orifice construction in accordance with the present invention.

FIGS. 2 and 3 illustrate an air knife including an elongated plenum A having a longitudinal opening. A longitudinal support B is fixed on one side of the opening. A longitudinal flat plate forms a flexible baffle C extending on one side of the opening across the support forming one side of a longitudinal orifice opposite said opening. A longitudinal flexible blade D is fixed to the plenum along the other side of the opening presenting a free edge portion opposite the baffle. Threaded means E are spaced along the opening extending between the blade and the support for drawing the free edge portion of the blade toward and away from said baffle varying the size of the orifice permitting adjustment therealong.

FIG. 2 illustrates an elongated plenum A having an opening 20 therein extending longitudinally of the plenum. The plenum has an end plate 21 illustrated in broken line in FIGS. 2 and 3. The end plate has an opening 21*a* receiving an inlet pipe 22 carrying, at both ends of the plenum, a supply of air under pressure thereto. Mounting brackets are illustrated at 23 in FIG. 2 as carried upon the inlet pipes 22 for offering support at each end of the air knife.

The elongated plenum carries a longitudinal support B which is a substantially wedge shaped block suitably welded, as at 24 and 25, for acting as a support for the flat plate which forms the flexible baffle C. The plate may be suitably secured as by gluing in position upon the support. The plate D is secured along one edge on the other side of the opening as by headed fasteners 26 substantially tangentially to the plenum, but upon a mounting strip 27 suitably secured to the plenum as by welding. The threaded means E are provided to include a shank portion 28 which is threadably received on one end by the support B while another unthreaded portion passes through the plate D and carries a head 29 provided with a suitable lock washer 30.

While a preferred embodiment of the invention has been described using specific terms, such description is for illustrative purposes only and it is to be understood that changes and variations may be made without departing from the spirit or scope of the following claims.

What is claimed is:

1. An air knife including an elongated plenum having a longitudinal opening comprising:

a longitudinal support on one side of said opening;

a longitudinal plate forming a flexible baffle extending on said one side of said opening and being fixed across said support adjacent said opening forming one side of a longitudinal orifice opposite said opening;

a longitudinal flexible blade fixed to said plenum, along the other side of said opening presenting a free edge portion opposite said baffle;

threaded means spaced along said opening extending between said blade and said support for drawing the free edge portion of said blade toward and away from said baffle varying the size of said orifice permitting adjustment therealong; and said baffle and said blade presenting a converging substantially streamlined flow path.

2. The structure set forth in claim 1 wherein said plenum is generally circular, and said flexible blade is flat extending substantially tangentially to said plenum.

* * * * *